United States Patent [19]

Czerwinski

[11] 4,217,591

[45] Aug. 12, 1980

[54] HIGH FREQUENCY ROLL-BAR LOOP ANTENNA

[75] Inventor: Watson P. Czerwinski, Forked River, N.J.

[73] Assignee: The United States of America as represented by the Secretary of the Army, Washington, D.C.

[21] Appl. No.: 69,958

[22] Filed: Aug. 27, 1979

Related U.S. Application Data

[63] Continuation-in-part of Ser. No. 944,043, Sep. 20, 1978, abandoned.

[51] Int. Cl.[3] ..... H01Q 1/32; H01Q 7/00

[52] U.S. Cl. ..... 343/713; 343/744; 343/845; 343/856

[58] Field of Search ..... 343/711, 712, 713, 741, 343/743, 744, 845, 856

[56] References Cited

U.S. PATENT DOCUMENTS 2,431,124 11/1947 Kees et al. ..... 343/845

*Primary Examiner*—Eli Lieberman

*Attorney, Agent, or Firm*—Nathan Edelberg; Sheldon Kanars; Michael Zelenka

[57] ABSTRACT

A vehicular mounted loop antenna which operates as an NVIS radio communication antenna over one range of frequencies and as a vertically polarized whip antenna over another range of frequencies corresponding to the frequency range of a radio communication set equipped with a conventional whip antenna. A coupling loop of variable area and a transmitting loop are positioned in a common vertical plane on a horizontally disposed base member, with the coupling loop positioned within the transmitting loop. A variable capacitor is in circuit with, and is an integral element of, the transmitter loop to provide resonance over the desired operating frequency range.

4 Claims, 3 Drawing Figures

FIG. 1
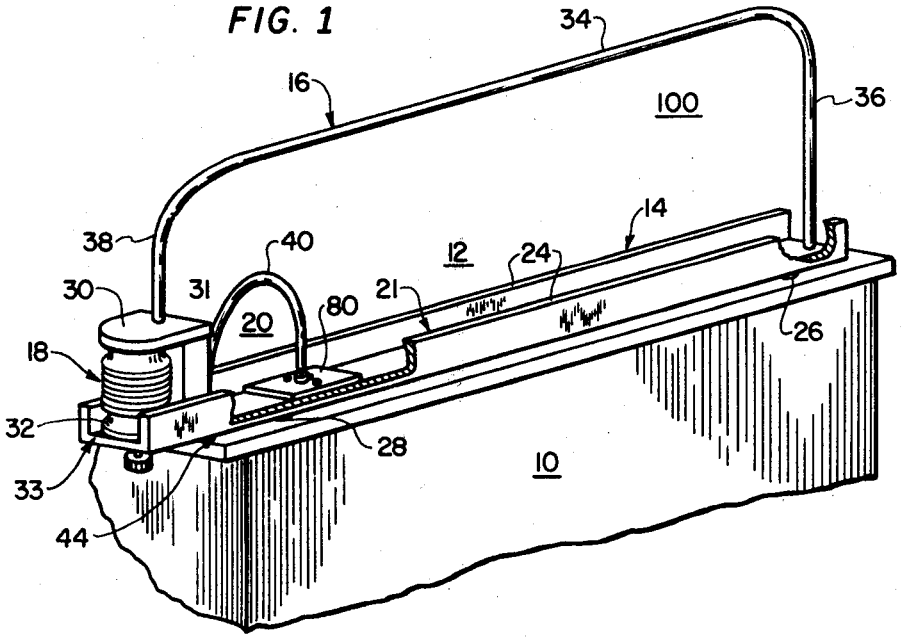
FIG. 2
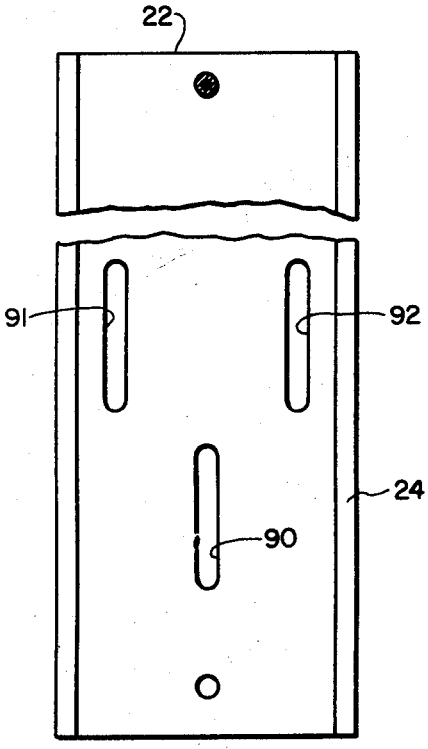
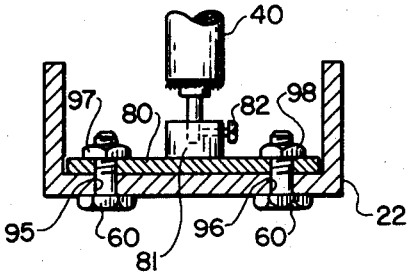
FIG. 3

HIGH FREQUENCY ROLL-BAR LOOP ANTENNA

BACKGROUND OF THE INVENTION

This application is a continuation-in-part of the copending application of Watson P. Czerwinski, entitled "High Frequency Roll-Bar Loop Antenna", filed Sep. 20, 1978, given Ser. No. 944,043, now abandoned, upon the filing of this application.

This invention relates to HF communication antennas adapted for mobile vehicular operation and more particularly to vehicular mounted vertical loop antennas which provide for an increased S/N ratio and increased range and efficiency.

High frequency antennas for tactical vehicular application are, by necessity, electrically and physically small. For mobile vehicular applications, a very short and therefore inefficient whip antenna is generally used which is an integral part of the moving vehicle. Such whip antennas characteristically operate over a relatively narrow range of frequencies, 8 MHz to 30 MHz for example, and have limited range since they rely only on ground wave propagation for communication. Because of ground losses over the propagation path, the communication range of such whip antennas was usually found to be limited to a distance of 20 miles. Furthermore, since such whip antennas are characterized by high reactive feed points, an extensive impedance network is required within the radio set in order to tune the whip antenna over the required operating frequency range. Unavoidable losses in such impedance matching networks lead to a significant rise in temperature when operating the radio communication set, particularly at the low end of the operating frequency band. The rise in temperature, of course, results in undesirable overheating problems which deleteriously affect the operation of the radio communication equipment. One well known method for increasing the range of radio communication and overall radiation efficiency employs the Near Vertical Incidence Skywave technique hereinafter referred to as NVIS. Generally, NVIS has been limited to fixed immobile station applications wherein a one-half wave dipole, about 100 feet long, is affixed between two masts about 40 feet high. Obviously, such a system cannot be used tactically in moving vehicles. In general, radio communication systems utilizing the NVIS technique rely on the principle that most of the radio energy is reflected by the ionosphere to achieve efficient operation over a frequency range of 2 to 8 MHz.

The disadvantage of the size of these systems has been partially overcome by the invention described in U.S. Pat. No. 3,588,905 issued to John H. Dunlavy Jr. on June 28, 1971 and entitled Wide Range Tuneable Transmitting Loop Antenna. That invention features a single turn tuned primary, inductively fed by a small, single turn untuned secondary.

In that patent, Mr. Dunlavy notes the coupling between the primary and secondary loops is a function of the ratio of the area circumscribed by those loops and goes on to select essentially circular loops of fixed area which provide a maximum impedance mismatch of 2:1. This antenna arrangement, while a considerable improvement over the prior art, suffers the disadvantage of requiring a primary loop of approximately five foot diameter and a secondary loop of approximately five inch diameter for frequencies in the range of 2–30 MHZ. Antennas of this size are ill suited for military vehicular mounting since their height makes them cumbersome and an easily identifiable target.

BRIEF SUMMARY OF THE INVENTION

It is an object of the present invention to provide a vehicular mounted loop antenna which overcomes the aforesaid limitations.

It is another object of the present invention to provide an improved vehicular mounted loop antenna adapted to provide NVIS operation over one frequency range and vertically polarized whip antenna operation over a second frequency range above the NVIS frequency range, both types of operation being effective while the vehicle is in motion.

It is another object of the present invention to provide an improved vehicular mounted loop antenna whose height is significantly less than conventional whip and loop antennas and which provides an extended communication frequency range while the vehicle is in motion.

In accordance with the present invention, the loop antenna is adapted for operation on a moving vehicle. It includes a metallic base horizontally positioned on top of the vehicle and a vertically positioned metallic loop element one end of which is terminated at the metallic base. Also included is a variable capacitor which is connected between the other end of the metallic loop element and the metallic base to form a closed loop. Included further is a coupling loop, a portion which is a vertically positioned coaxial cable loop coplanar with the metallic loop element, and is slidably mounted on the metallic base so as to permit adjustment of the area under the coaxial cable loop thereby enabling the maintenance of fifty ohm input impedance at the antenna input terminal. The invention utilizes a semi-rectangular transmitting loop providing a relatively low profile as compared to those loop antennas of the prior art while overcoming the inherent coupling problems of this lower profile configuration by providing a coupling loop having a variable area.

BRIEF DESCRIPTION OF THE DRAWINGS

FIG. 1 shows a plan view of the loop antenna mounted on a vehicle; and

FIG. 2 is a top view of the metallic base showing mounting slot location;

FIG. 3 is a detail view of one termination of the coaxial cable forming a portion of the coupling loop.

DETAILED DESCRIPTION OF THE INVENTION

Referring now to FIGS. 1 and 2 of the drawing, there is shown at 10 the roof of a mobile vehicle on which is mounted a loop antenna 12. The integral components of loop antenna 12 comprise a metallic mounting bar 14, a metallic loop element 16 having a circular cross section, a variable capacitor 18, an input terminal 44, and a coupling loop 20. Mounting bar 14 as shown, is transversely positioned across the roof of vehicle 10, is U-shaped in cross section to form a channel 21 having a base section 22 and upward extending flanges 24. Spaced, insulating, mounting pads 26 and 28 affix the base 22 of mounting bar 14 to the roof of vehicle 10. One end of metallic loop element 16 is terminated within channel 21 and is affixed to base 22 at one extreme of mounting bar 14. The other end of metallic loop element 16 is affixed to one terminal plate 30 of variable capacitor 18 and the other terminal plate 32 of capacitor 18 is affixed to base 22 of channel 21. An insulator support block 31 is positioned between channel base 22 and ungrounded capacitor plate terminal 30 for support purposes. As shown, metallic loop element 16 includes an elongated central section 34 substantially parallel to and vertically spaced from mounting bar channel 21, and curved terminating sections 36 and 38, which as hereinabove described terminate respectively within mounting terminal channel 21 and at ungrounded capacitor plate 30. The diameter of metallic loop element 16 is substantially the same as the width of channel base 22. By such an arrangement, metallic loop element 16, mounting bar 14, and variable capacitor 18 form a closed transmitting loop 100 in a vertical plane.

Coupling loop 20 in the preferred embodiment is comprised of a coaxial cable 40, slidably mounted on channel 21 proximal variable capacitor 18, which, in combination with channel 21, slide 80 and a portion of terminal 44 forms a second vertical loop within the closed loop and vertical plane hereinabove described, so as to provide a pair of coplanar loops. There is no electrical significance to mounting coupling loop 20 proximal variable capacitor 18 and coupling loop 20 may be mounted anywhere within transmitting loop 100 with the same electrical result. One end of coupling loop 20 is terminated by terminal 44. This terminal is proximal variable capacitor 18 and extends through slot 90 in channel base 22. Slot 90 is a longitudinal slot in channel base 22 located proximal to variable capacitor 18 and central to the flanges 24. Slot 90 must be sufficiently wide to accommodate the terminal 44 of coaxial cable 40 proximal variable capacitor 18, an N type female #20-654 connector in the preferred embodiment. Terminal 44 provides an input connection to the antenna. The electrical connection at this end of coaxial cable 40, that is the end proximal variable capacitor 18, is such that the inner conductor of coaxial cable 40 is electrically insulated from the channel base 22 and the outer conductor of coaxial cable 40 is grounded to the channel base 22. The other end of coaxial cable 40, distal variable capacitor 18 is terminated, as illustrated in FIG. 3, by allowing the outer conductor of coaxial cable 40 to remain a small distance, one-half to three-quarters of an inch in the preferred embodiment, away from channel base 22, so that it is electrically floating, and by grounding the inner conductor to channel base 22 through slide 80. In the case of signal transmission, this arrangement permits current from the signal source to enter the center conductor of coaxial cable 40 at input terminal 44 and travel down the center conductor to slide 80 thence along channel base 22 to the outer skin of the outer conductor of coaxial cable 40 at input terminal 44 then along the outer skin of the outer conductor of coaxial cable 40 to the terminus of the outer conductor of coaxial cable 40 distal variable capacitor 18 and then back along the inner skin of the outer conductor of coaxial cable 40 to input terminal 44 and thence to the signal source. Signals are coupled from coupling loop 20 to transmitting loop 100 by means of inductive coupling and the electrical characteristic may be considered that of a "space transformer" having a tuned primary loop, transmitting loop 100, and an untuned seondary, coupling loop 20.

Slide 80 is slidably mounted in channel 21 by means of two ¼-28 bolts 60 which pass through slots 91 and 92 in channel base 22 and pass through two suitable clearance holes 95, 96 drilled in slide 80 so as to secure slide 80 to channel base 22 when tightened into units 97 and 98. The slide 80, as illustrated in FIG. 3, provides a hole 81 to accommodate the center conductor of coaxial cable 40 and a set screw 82 to secure the center conductor in place. Slots 91 and 92 are longitudinal slots in channel base 22 and have an interslot spacing such that the terminus of coaxial cable 40, distal variable capacitor 18 mounts in slide 80 central to the channel flanges 24.

This mounting configuration of coupling loop 20 provides lineal movement of both ends. Since the area encompassed by the transmitting loop 100 of the antenna of the invention is fixed, any variation in the area encompassed by coupling loop 20 will result in a variation in the inner loop area to outer loop area ratio and accordingly will effect the input impedance at input terminal 44. By adjusting both variable capacitor 18 and the area encompassed by coaxial cable 40, the coupling between the inner and outer loops may be optimized while maintaining the desired input impedance.

The testing of one preferred embodiment of the invention having a transmitting loop 100 of approximately seven and one-half feet in length and approximately 2 feet in height indicated a necessity to change the area of the coupling loop 20 which was approximately sixteen inches in diameter, for each fourfold change in frequency. Additional adjustments may be desirable in instances when input impedence is more critical or where the dimensions of the transmitting loop 100 are varied.

While the preferred embodiment described utilizes a coupling loop 20 which is at times coincident with transmitting loop 100, it is recognized this arrangement is not critical to the operation of the invention and that a coupling loop having an adjustable area located entirely within and coplanar with the transmitting loop will function as well.

What is claimed is:

1. A loop antenna for operation on a moving vehicle comprising:

a metallic base mounted longitudinally on top of said vehicle;

a vertically mounted elongated, metallic loop element having one end affixed to said metallic base;

a variable capacitor in series with the other end of said metallic loop element and said metallic base and in conjunction with said metallic base and said elongated metallic loop element forming a closed transmitting loop;

a coupling loop of variable area, coplanar with and at no point exterior to, said closed transmitting loop and inductively coupled thereto; and an input terminal electrically connected to said coupling loop for feeding a signal into or removing a signal from said coupling loop.

2. The loop antenna of claim 1 wherein said coupling loop is partially comprised of a coaxial cable, slidably mounted on, and electrically connected to, said metallic base thereby providing said coupling loop with a variable area so as to permit adjustment to the input impedance of said loop antenna.

3. The loop antenna of claim 2 wherein said metallic base comprises a U-shaped channel.

4. The loop antenna of claim 3 wherein said closed transmitting loop is approximately rectangular in shape.

* * * * *